US007987528B1

(12) United States Patent
Ross

(10) Patent No.: US 7,987,528 B1
(45) Date of Patent: Aug. 2, 2011

(54) PEDAL OPERATED DEVICE

(76) Inventor: Michael D. Ross, Wantaugh, NY (US)

( * ) Notice: Subject to any disclaimer, the term of this patent is extended or adjusted under 35 U.S.C. 154(b) by 367 days.

(21) Appl. No.: 12/272,778

(22) Filed: Nov. 17, 2008

Related U.S. Application Data

(63) Continuation-in-part of application No. 11/141,067, filed on May 31, 2005, now Pat. No. 7,644,451.

(51) Int. Cl.
*A47K 13/10* (2006.01)

(52) U.S. Cl. ..... 4/246.3

(58) Field of Classification Search ..... 4/246.1–246.5, 4/253, 272, 273; 220/262–264
See application file for complete search history.

(56) References Cited

U.S. PATENT DOCUMENTS

| | | | | |
|---|---|---|---|---|
| 3,055,016 | A | 9/1962 | Kemp | |
| 3,303,517 | A * | 2/1967 | Wood et al. | 4/246.4 |
| 4,030,146 | A | 6/1977 | Pilkington et al. | |
| 4,534,073 | A | 8/1985 | Smith | |
| 4,649,576 | A | 3/1987 | Lillie | |
| 5,199,119 | A * | 4/1993 | Weber | 4/619 |
| 5,327,589 | A | 7/1994 | Rice | |
| 5,487,192 | A | 1/1996 | Hodges | |
| 5,829,068 | A | 11/1998 | Smith | |
| 5,852,833 | A | 12/1998 | Gregoire | |
| 6,151,723 | A | 11/2000 | MacAllister | |
| 6,189,160 | B1 * | 2/2001 | Pettus | 4/246.1 |
| 6,470,503 | B1 | 10/2002 | Holmes | |
| 6,807,687 | B2 | 10/2004 | Marras | |
| 7,254,846 | B2 | 8/2007 | Kim | |
| 2005/0246827 | A1 * | 11/2005 | Kim | 4/246.1 |
| 2006/0015992 | A1 | 1/2006 | Harper | |
| 2006/0041997 | A1 * | 3/2006 | Kist et al. | 4/246.1 |
| 2006/0179557 | A1 | 8/2006 | Harper | |

FOREIGN PATENT DOCUMENTS

| | | | |
|---|---|---|---|
| GB | 2348214 | A1 | 9/2000 |
| WO | 8804534 | A1 | 6/1988 |
| WO | 2004062453 | A1 | 7/2004 |

* cited by examiner

*Primary Examiner* — Gregory Huson
*Assistant Examiner* — Janie Christiansen
(74) *Attorney, Agent, or Firm* — The Merek Group, Inc.; Joseph C. Merek

(57) ABSTRACT

A linkage for moving a hinged member from a first position to a second position. The hinged member may be a toilet seat, the lid of a toilet seat, or any other hinged member. The linkage is provided with first and second pedals where the first pedal moves the seat from the first (or lowered) position to a second (or raised) position. The second pedal moves the seat from the second position to the first position. The linkage is preferably provided with a biasing member to assist the seat in moving from the first position to the second position and acts as a dampening mechanism when the seat is moved from the second position to the first position.

21 Claims, 3 Drawing Sheets

PEDAL OPERATED DEVICE

This application is a continuation-in-part of prior application Ser. No. 11/141,067 now U.S. Pat. No. 7,644,451, filed May 31, 2005, the entirety of which is incorporated by reference herein.

BACKGROUND OF THE INVENTION

1. Field of the Invention

The present invention relates generally to lifters and, more specifically, to a pedal operated device to facilitate moving an articulated load from a lowered position to a raised position and returning the load to the lowered position.

To this end, the device includes a base member with an attached support member supporting a first pedal. A second pedal is pivotally connected to the first pedal. A link is pivotally connected to the first pedal adjacent one end of the link and the link is secured to seat adjacent a second end of the link. The load is moved to the raised position by the user applying foot pressure to the first pedal. The user is able to return the seat to the lowered position from the raised position by foot pressure on the second pedal.

The device may be provided with a biasing member fastened between an anchor and an adjusting mechanism. The anchor may be secured to the first pedal and the adjusting mechanism may be secured to either the support member or the base. The adjusting member allows the user to adjust the speed of the load during its descent while moving from the raised position to the lowered position. The adjusting mechanism also allows the user to adjust the amount of assist the biasing member provides during the load ascent while moving from the lowered position to the raised position.

The instant invention additionally may include a sliding stop member adjustably fastened to the base thereby enabling the user to vary the length of the base member length and to lock the sliding stop in a desired position.

The present invention is shown in use with a toilet seat but is not limited to this use. It is envisioned that the pedal operated device may be employed on pivotal loads such as but not limited to doors, lids, or any other pivotal load where it is desired to enable the user to move the load by employing foot pressure. It is possible to locate the device in relation to the load where the user could employ other parts of the body to operate the first and second pedals. The present invention shall not be limited to be operated by foot pressure but may be operated by any other part of the body such as but not limited to hands, arms, elbows, knees, or any other part of the body as desired by the user.

2. Description of the Prior Art

There are various devices such as toilets and trash receptacles having articulated loads in the form of hinged lids and many devices have been devised to alleviate the user from having to move these lids using their hands from their closed position to an open position and vice-versa. As illustrated in the prior art, typically some type of foot operated actuator is employed.

Illustrative of these are U.S. Pat. No. 1,276,472 issued to Zeen on Aug. 20, 1918 and U.S. Pat. No. 3,055,016 to Kemp on Sep. 25, 1962.

While these other lifting devices may be suitable for the purposes for which they were designed, they would not be as suitable for the purposes of the present invention, as hereinafter described.

SUMMARY OF THE PRESENT INVENTION

The primary object of the present invention is to provide a foot-pressure actuated pedal linkage in engagement with an articulated load whereby a user can selectively apply foot-pressure to the first pedal to displace the load from a seated position to a raised position and then apply foot-pressure to the second pedal to return the load to its seated position.

A further object of the present invention is to provide a floor engaging support whereby a pedal can be pivotally mounted thereon.

A still further object of the present invention is to provide a link pivotally connected to the first pedal and extending therefrom.

Yet another object of the present invention is to provide the link with a pivot pin or bearing member positioned proximate the distal end thereof.

An additional object of the present invention is to fasten the pivot pin or bearing member to the articulated load.

A yet further object of the present invention is to provide the linkage with a roller or pivotal member positioned proximate a distal end of the first pedal to make contact with the lower end of the link.

BRIEF DESCRIPTION OF THE DRAWING FIGURES

DESCRIPTION OF THE REFERENCE NUMERALS

Figure 1:
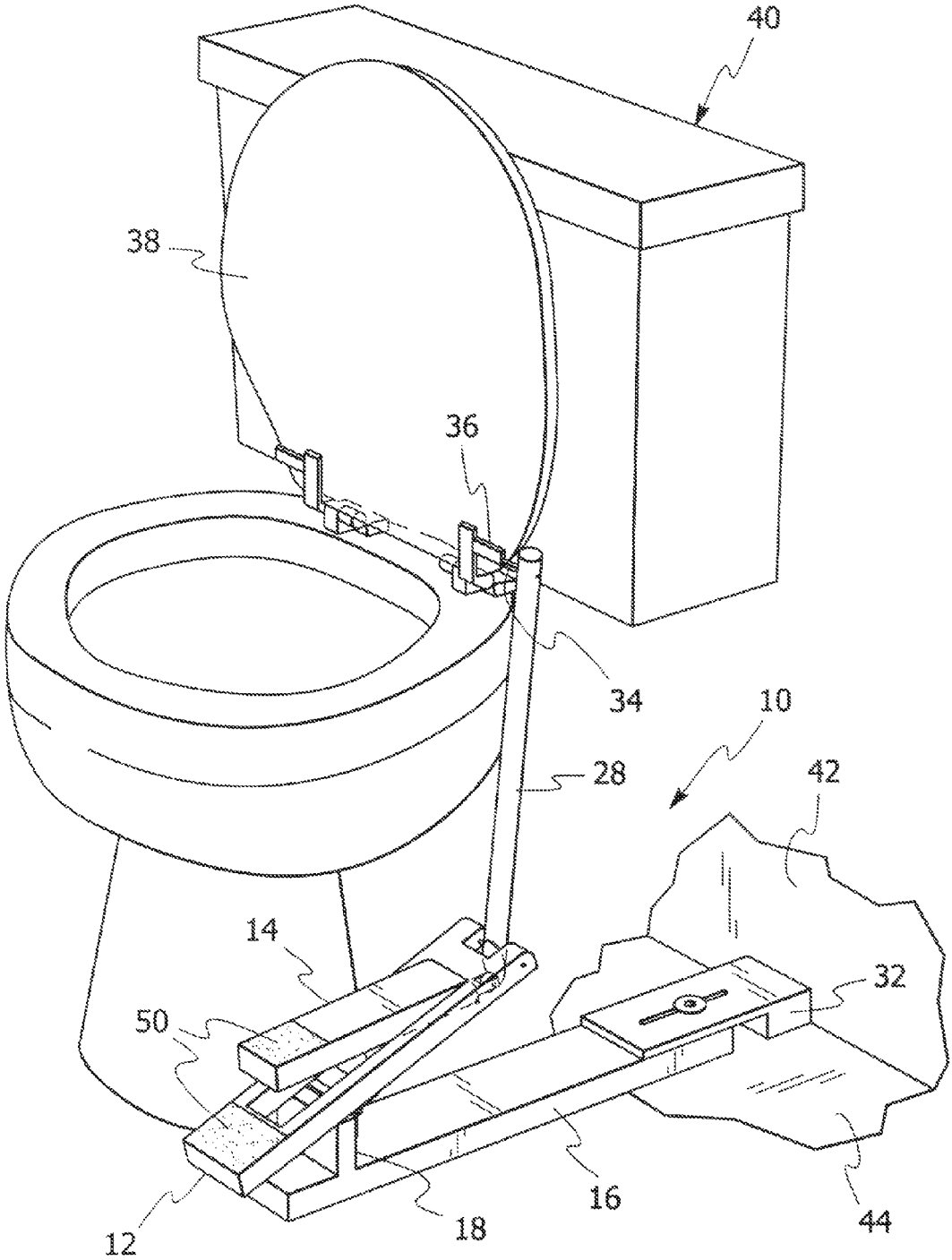
FIG. 1 is a perspective view of the present invention in use on a toilet seat showing the seat in the raised position.

Turning now descriptively to the drawings, in which similar reference characters denote similar elements throughout the several views, the Figure illustrates the pedal operated articulated load displacement device of the present invention. With regard to the reference numerals used, the following numbering is used throughout the various thawing Figures.

10 present invention
12 first pedal
14 second pedal
16 base member
18 support member
20 hinge
22 biasing member
24 pivotal member
26 adjustment mechanism
28 link
30 second pedal extension
32 sliding stop
34 pivot pin
36 mounting block
38 seat
40 toilet
42 wall
44 floor
46 fastener
48 lower end of link
50 anti-slip material
52 threaded fastener
54 washer

DETAILED DESCRIPTION OF THE PREFERRED EMBODIMENT

The following discussion describes in detail one embodiment of the invention. This discussion should not be construed, however, as limiting the invention to those particular embodiments; practitioners skilled in the art will recognize numerous other embodiments as well. For definition of the complete scope of the invention, the reader is directed to appended claims.

Figure 2:
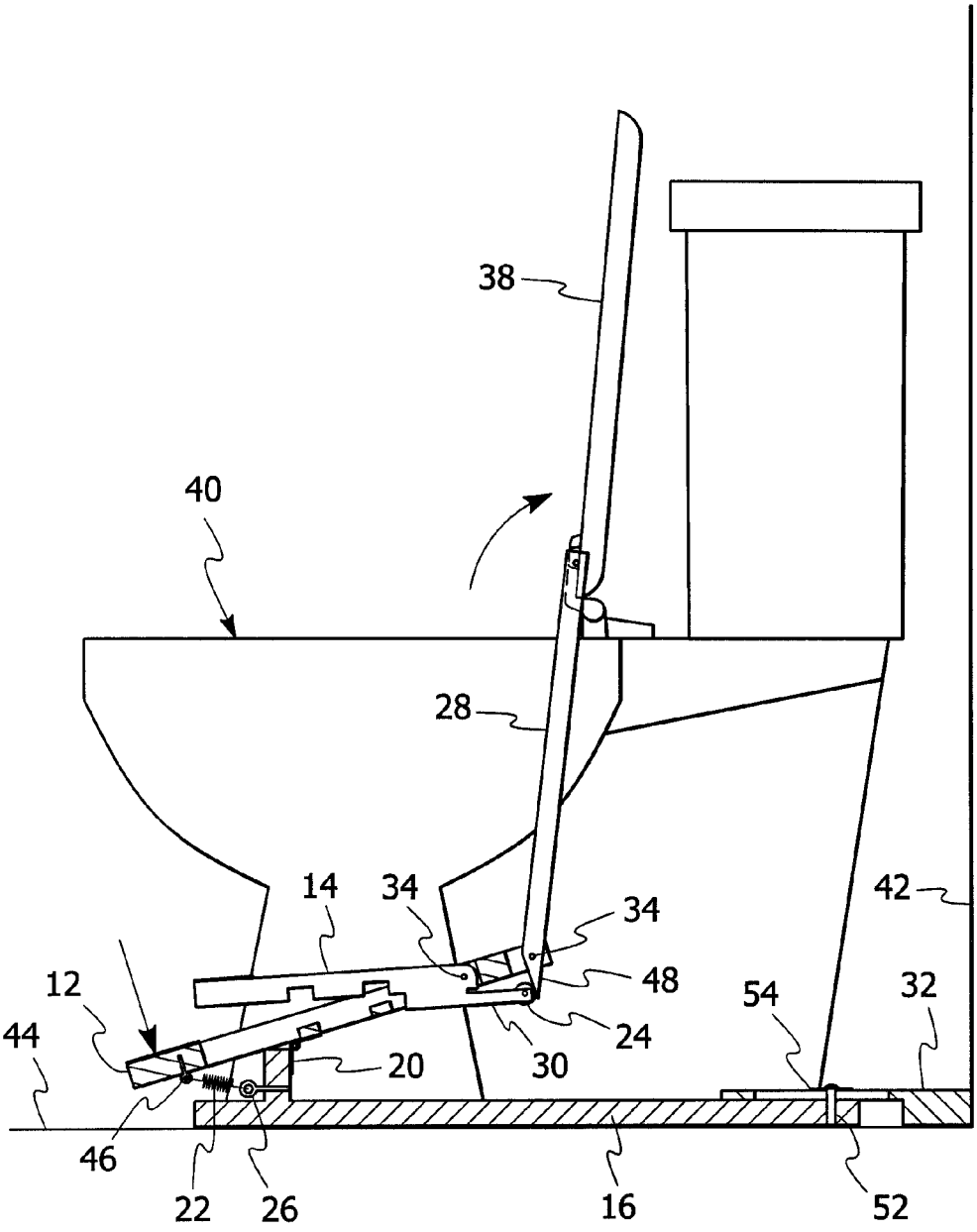
FIG. 2 is a partial sectional view of the present invention in use on a toilet seat showing the seat in the raised position.
Figure 3:
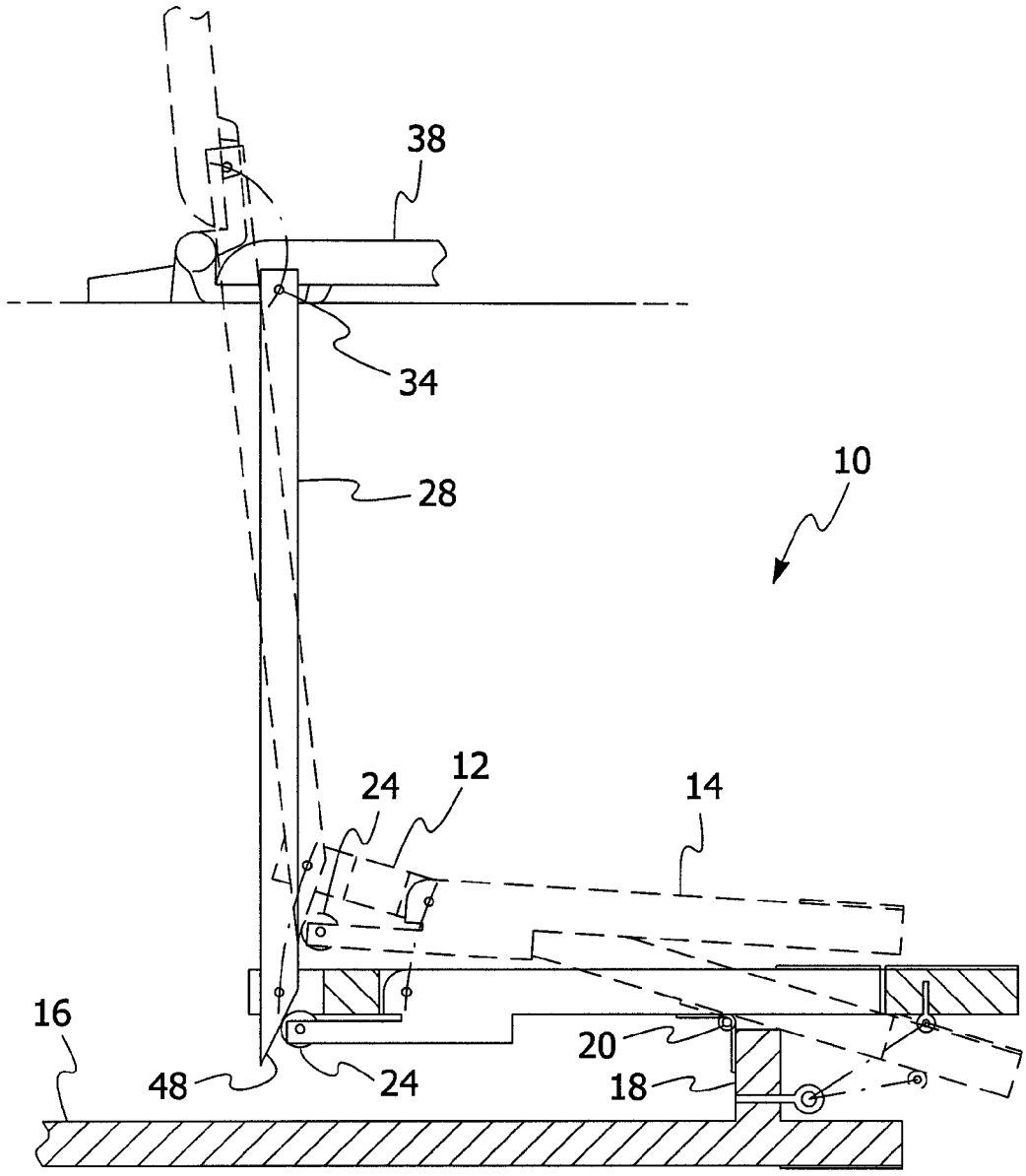
FIG. 3 is side sectional view of the present invention in use on a toilet seat showing the seat in the lowered position (bold lines) and in the raised position (dashed lines).

Turning now descriptively to the drawings, in which similar reference characters denote similar elements throughout the several views, FIGS. 1-3 illustrate the pedal operated linkage of the present invention which is indicated generally by 10. The linkage of the present invention 10 may be used to raise and lower the seat 38 of a toilet 40. The linkage may be used to lift the seat cover or lid and the seat 38 when the seat cover or lid rests upon the seat 38. Preferably, the linkage is connected to the seat 38 but the linkage may be connected to the cover or lid to raise and lower only the lid.

The linkage includes a base member 16, which typically rests on the floor 44 beside the toilet 40, to provide support for the remaining components of the linkage. The base member 16 may include a sliding stop 32. The sliding stop 32 allows for variation in the distance the present invention 10 is set off from the wall 42 behind the toilet 40. The sliding stop 32 acts as a brace for the base member 16 by preventing it from moving towards the wall 42 when the user operates the linkage of the present invention 10. The sliding stop 32 also allows the user to adjust the orientation of the linkage with respect to the seat 38 since the sliding stop 32 is adjustable in its relationship with the base member 16. By varying the position of the sliding stop 32 with respect to the second end of the base member 16 the user is able to fine-tune the movement of the linkage when the seat 38 is raised or lowered. The sliding stop 32 is shown as having an extended portion that rides over the base member 16 but it is envisioned that the base member 16 may be positioned over the extended portion of the sliding stop 32 and the bottom of the base member 16 would be provided with a notched or cutout area so the that the top of the base member 16 is flush with the top of the sliding stop 32. The sliding stop 32 would be flipped over so that the extended portion (of the sliding stop) rests on the floor 44 with the notched portion of the base member 16 resting on or over the extended portion of the sliding stop 32. The notched area of the base member 16 would extend inward from the second end at least a distance equal to the length of the extended portion of the sliding stop 32. This will allow the thicker portion of the sliding stop 32 to contact the second end of the base member 16 when the sliding stop 32 is in the fully retracted position where the combined length of the base member 16 and the sliding stop 32 is as short as possible. The base member 16 may be provided with a notched portion on the upper surface so that the sliding stop 32 and the base member 16 will be flush with each other and be of the same thickness enabling them to be made from the same stock material (not shown). It is also envisioned that base member 16 and the sliding stop 32 may be provided with any type of sliding engagement that allows for sliding stop 32 to be secured in a variety of positions closer or further away from the second end of the base member 16. The base member 16 may be provided with a slot that is cut parallel to and intermediate with the upper and lower surfaces of the base member 16 to receive the extended portion of the sliding stop 32. The extended portion of the sliding stop 32 would then be positioned intermediate the upper and lower surfaces of the thicker portion of the sliding stop 32. The sliding stop 32 is shown as being secured by a threaded fastener 52 (see FIGS. 1 and 2) and a washer 54 but it is envisioned that the sliding stop 32 may be secured by any suitable means such as hook and loop fasteners commonly known as VELCRO, a snap fit relationship between the base member 16 and the sliding stop 32, a friction fit between the two, or a saw tooth locking relationship where the slot is provided with teeth that cooperate to locking engage with teeth on the extended portion of the sliding stop 32. The threaded fastener 52 extends through a slot (see FIG. 2) in the sliding stop 32 and secures the sliding stop in a variety of desired positions with respect to the base member when the threaded fastener 52 is sufficiently tightened. The threaded fastener 52 may be received into a hole in the base member where the hole itself may be threaded or a threaded insert may be secured in the hole. The washer 54 shown in FIGS. 1 and 2 is optional and is typically not required when the head of the threaded fastener is large enough to span the slot in the sliding stop 32 and securely hold the sliding stop 32 in place without the washer 50.

The base member 16 preferably includes a support member 18 that elevates the first pedal 12 above the base member 16. The support member 18 acts as a fulcrum for the first pedal 12 since the first pedal 12 is pivotally secured to the support member 18. The support member 18 is positioned intermediate the ends of the base member 16 but is positioned closer to the first end of the base member 16. The support member 18 is shown in FIGS. 1 and 2 as being generally rectangular but may be formed in any shape so long as it performs the function of the fulcrum, enables the first pedal 12 to be pivotally connected thereon, and allows for the first pedal 12 to pivot through its required range of motion. The first pedal 12 is shown as being connected to the support member 18 by a simple hinge 20 but may be connected by any means that pivotally connects or secures the first pedal 12 to the support member 18. The support member 18 is shown as being integrally formed with (one-piece construction) the base member 16 but it may be formed from a separate piece and secured to the base member 16. The support member 18 and the base member 16 when formed of separate parts may be made so that the position of the support member 18 with respect to the first end of the base member 16 is adjustable. This will allow the user to move the support member 18 closer to or further away from the first end of the base member 16 and provide another means for the user to fine-tune the movement of the linkage. This could be accomplished by providing the support member 18 with a base portion that is wider that the thickness of the upper end of the support member 18. This would give the support member 18 an inverted "T" shape in cross-section. The wide part of the "T" would be provided with holes that would align with holes or slots in the base member 16 to secure the support member 18 to the base member 16. The holes or slots may receive a threaded fastener(s) or friction pins to secure the support member 18 in the desired position on the base member 16. It is envisioned that the first pedal 12 may be pivotally connected in a variety of ways to the support member 18. The support member 18 and the first pedal 12 may each be provided integral hinge elements, where each carries one half of a mating hinge. When the hinge elements are brought together they form the hinge 20. The components of hinge 20 may be secured together with a fastener such as a pin or they may be secured together by a plastic deformation of the hinge components known in the hinge art as snap lock or snap fit.

The first pedal 12 has a second pedal 14 pivotally secured therein. The second pedal 14 is narrower than the first pedal 12 and pivots within and between the sides of the first pedal 12 (see FIG. 1). The second pedal 14 has first and second ends that are spaced inward from the first and second ends of the first pedal 12 as seen in FIG. 2. The second pedal 14 has a pivot pin 34 adjacent its second end. The pivot pin 34 pivotally secures or connects the second pedal 14 to the first pedal 12. It should be noted that the pivot pin 34 (securing the second pedal 14 to the first pedal 12) is at a location that is spaced apart from the hinge 20 along the length of the first pedal 12. This provides each of the pedals with a different pivot points along the length of the first pedal 12. The second pedal 14 is provided with an extension 30 that is positioned below the lower surface of the first pedal 12 so that it extends toward the second end of the first pedal 12. This extension 30 is positioned below the first pedal to avoid interference or contact with the support member that connects the two sides of the first pedal 12 and is positioned between the link 28 and the second pedal 14. The extension 30 includes a terminal or free end. A pivotal member 24 or rotating member) such as but not limited to a roller is secured adjacent the terminal or free end of the extension 30. The pivotal member 24 makes or is in contact with the tapered or beveled actuating surface on the end of the link 28 or push rod to cause the link to move the seat 38 from the raised position (where the seat is up) to the lowered position (where the seat rests on the bowl of the toilet 40). When the user steps on the second pedal 14 it forces the pivotal member 24 against or along the beveled actuating surface of the link 28 and the link moves the seat 38 from the raised position to the lowered position. When the seat 38 is in the raised position the second pedal 14 is raised relative to the first pedal 12 which enables the user to step on the second pedal 14 and move it toward the first pedal 12 forcing the pivotal member 24 against or along the lower end of the link 28 thereby causing the seat 38 to move to the lowered position. The extension 30 may be in the same plane as the second pedal 14 provided the support member is positioned behind link 28. This would close off the open or notched end of first pedal 12 and would create an open space between the end of second pedal 14 and the link 28. The extension 30 would then extend directly rearward from the second end of the second pedal 14 and could be made in one-piece with the second pedal 14 and may have the same thickness as the second pedal 14.

The lower end 48 of the link 28 or push rod is beveled or tapered. This enables the link 28 to return the seat 38 to the lowered position when the pivotal member 24 is forced against or along the tapered or beveled portion of the link 28. It is envisioned that the beveled end or portion may be reinforced since it is a stress point in the link 28. The reinforcement may be in the form of a metal sleeve in the same shape as the lower end of the link 28. The sleeve would be slid over the lower end and secured in place with adhesive or a small threaded fastener. It is also envisioned that the link 28 may be made of a plastic material and the link 28 could be reinforced by adding fibers to the plastic where the fibers may be carbon, aramid, or other suitable reinforcing materials.

The lower end of the push rod or link 28 is pivotally secured to the first pedal 12 adjacent the second end of the first pedal 12. The pivotal joint between the two may be a simple pivot pin 34 similar to pin that secures the second pedal 14 to the first pedal 14. Either of these pins 34 may be cylindrical and will allow for pivotal movement between the joined members. The second end of the first pedal 12 is shown with an open notched portion to receive the link 28 or push rod as seen in FIG. 1. It is envisioned that open end of the notched portion may be closed by a support member that extends between the two free ends of the first pedal 12 (not shown). Thus the link 28 will extend through a hole or an opening in the first pedal 12 adjacent the second end of the first pedal 12. It is also envisioned that the link 28 may be fabricated from a different material than that of the other parts of the linkage. The link 28 or push rod may be made from a metal such as aluminum or steel while the rest of the linkage may be made of plastic or wood. The upper end of the link 28 or push rod is pivotally secured to the seat 38 of the toilet 40. The connection between the two may be a pivot pin 34 and a mounting block 36 where the mounting block 36 is secured to the seat and has a hole or opening to receive the pivot pin 34. This pin may be identical to the pin that secures the second pedal to the first pedal and the pin that secures the lower end of the link 28 to the second pedal 14. The pivot pin 34 and mounting block 36 allow for pivotal movement between the link 28 and the seat 38. The pivot pin 34 may have a spacer (not shown) positioned thereabout, which provides and maintains sufficient space between the link 28 or push rod and the mounting block 36. The spacer may be a sleeve that slides over the pivot pin 34 to provide the required space between the link 28 and the mounting block 36. The pivot pin 34 may be replaced with a threaded fastener (not shown). Preferably, the fastener would be threaded over only a portion of the shaft to enable the link 28 to pivot about the unthreaded portion of the fastener shaft. The free end of the fastener would be provided with threads to securely connect the fastener with the mounting block 36. The threaded fastener may be used with a spacer (not shown), which is a sleeve that slides over the fastener in the same manner as spacer that slides over the pivot pin 34.

A biasing member 22 is positioned between the support member 18 and the first pedal 12 as seen in FIG. 2. The biasing member 22 may be a spring, an elastic member, a gas or fluid charged device, or any other device that is capable of providing a biasing force on the first pedal 12. The biasing member 22 also acts as a dampening means when the seat 38 is moved from the raised position to the lowered position. The biasing member 22 is preferably provided with an adjustment mechanism 26, which enables the user to vary the biasing force of the biasing member 22. In the case where the biasing member 22 is a spring or an elastic member the adjustment mechanism 26 may be a threaded eyebolt. The "eye" end of the bolt would receive one end of the biasing member 22. The support member 18 could be provided with threads to receive the threaded end of the eyebolt. This would enable the user to screw the eye bolt into the support member 18 so that the "eye" end of the bolt moves closer or further away from the support member 18 to vary the biasing force of the biasing member 22. It is envisioned that a lock means may be provide to prevent the eyebolt from turning. This may be a threaded nut that is threaded onto the threaded end of the eyebolt so that it contacts the support member 18 and prevents the eyebolt from rotating thereby locking the eyebolt in the desired position. The threads in the support member 18 may be formed as an integral part of the support member 18 or may be provided on a separate part such as a threaded insert that is secured to the support member 18.

When the seat 38 is in the lowered position the second pedal 14 is substantially flush with the first pedal 12. There may be some variation in the position of the second pedal 14 with respect to the first pedal 12 depending on the orientation of the linkage and the position of the sliding stop 32 with respect to the second end of the base member 16. When the seat 38 is in the raised position the second pedal 14 is elevated or raised with respect to the first pedal 12 to enable the user to step on the second pedal 14 moving the second pedal towards the first pedal and thereby causing the seat 38 to move from the raised position to the lowered position.

FIG. 2 shows an arrow adjacent the first end of the first pedal 12 which represents the force that the user applies to the first pedal 12 to raise or lift the toilet seat 38. This figure also shows an arrow adjacent the pivotal connection between the upper end of the link 28 and the seat 38. This arrow reflects the pivotal movement of the seat 38 when it moves from the lowered position to the raised position. FIG. 3 is a side sectional view of the linkage and the seat 38 when the seat moves from the raised position to the lowered position. The dashed lines depict the seat 38 and the linkage in the raised position. The solid lines depict the seat 38 and linkage in the lowered position. The arced segments shown in FIG. 3 depict the movement of specific points on the linkage when the seat 38 moves from the raised to the lowered position. The linkage of the present invention 10 should not be limited by the detailed embodiment found in FIGS. 1-3 and 4. For example the support member is shown as generally rectangular in FIGS. 1-3 but can be of any shape (triangular, truncated triangle, etc) so long as it performs its required function. The second pedal is shown in FIG. 2 with notched portions to allow for clearance of support members that connect the opposed sides of the first pedal. It is envisioned that the first pedal may be constructed without these support members thus eliminating the need for the notched portions in the second pedal 14. The extension 30 is shown in FIG. 2 as being integral or made in one piece with the second pedal but it can easily be a separate part secured to the second pedal 14.

While the present invention is disclosed and shown as moving the seat 38 of a toilet 40 it is within the scope of the present invention that the linkage can be employed to move any hinged member or hinged load. The linkage of the present invention may be employed to move other hinged members such as but not limited to doors (cabinet, entry, or any other hinged door), a lid pivotally secured to a container (trash containers, hampers, or any other container with a hinged or pivotal lid), or any other pivotal load. The linkage enables the user to move the desired load employing a foot in the event their hands are busy or physically incapable of moving the load.

The present invention may be made of materials such as but not limited to wood, metal, plastic, fiber-reinforced plastics, combinations of these materials or any other suitable materials. It is within the scope of the present invention where different components of the linkage maybe made from the same material or from different materials. For example the base member 16 maybe be made of wood and the pedals made of plastic and the link 28 or push rod maybe made of metal. The base member 16 may be made of wood or plastic and the other components (the pedals, the support member, and the link) maybe made from the same wood or plastic material.

It is understood that the present invention is not limited to the embodiment or embodiments described above, but encompasses any and all of the embodiments within the scope of the following claims.

The invention claimed is:

1. An apparatus for moving a hinged member selectively between first and second positions, the apparatus comprising:

a first member having first and second ends and a length extending between said first and second ends, said first member being pivotally secured to a base member at a first location along said first member, a second member being pivotally connected to said first member at a second location along said first member, a link being pivotally secured to the first member proximate said first end of said first member, a first end of said link configured for attachment to the hinged member, a second end of said link having an actuating surface thereon, said first and said second locations being spaced apart along said length of said first member, the second member having a rotating member proximate a second end thereof, wherein when said second end of said first member is pivoted towards the base member the hinged member is moved from the first position to the second position, and wherein when a first end of said second member is pivoted towards the base member the rotating member moves along the actuating surface causing the link to return the hinged member to the first position.

2. The apparatus of claim 1, wherein when the hinged member is in the second position the first member forms an acute angle with the base member and the first end of the said second member is positioned above said second end of said first member.

3. The apparatus of claim 1, said second location being intermediate said first location and the first end of said first member.

4. The apparatus of claim 1, wherein said first member is provided with a tensioning device that is capable of applying a biasing force to said first member.

5. The apparatus of claim 4, wherein said tensioning device is selected from the group consisting of a spring and an elastic element.

6. The apparatus of claim 1, said base member including a support member elevating the first member above the base member and said first member is pivotally secured to said support member.

7. The apparatus of claim 6, wherein a tensioning device is secured between said support and said first member, said tensioning device being capable of applying a biasing force to said first member.

8. The apparatus of claim 1, wherein said actuating surface is tapered or beveled.

9. The apparatus of claim 1, wherein the first end of said link is provided with means for attaching said link to the hinged member.

10. The apparatus of claim 1, said first member having a width, and said second member pivots within the width of said first member.

11. The apparatus of claim 10, said second member having a width that is narrower than the width of said first member.

12. The apparatus of claim 1, wherein said base member includes a sliding stop proximate one end thereof.

13. The apparatus of claim 12, wherein the sliding stop is provided with means for securing it in a desired position relative to the base member.

14. The apparatus of claim 1, said second member having a length extending between said first and second ends, the length of said second member being less than the length of said first member.

15. The apparatus of claim 1, said second member has an extension extending below said first member toward said link member and said rotating member is attached adjacent a free end of said extension.

16. The apparatus of claim 1, including a tensioning device capable of biasing said second end of said first member toward said base member.

17. The apparatus of claim 16, when the hinged member is in the second position the free end of the extension is below the first end of said first member.

18. The apparatus of claim 1, wherein the hinged member is a toilet seat.

19. A hinged member in combination with apparatus for moving the hinged member, the combination comprising:

a first member having first and second ends and a length extending between said first and second ends, said first member being pivotally secured to a base member at a first location along said first member, a second member being pivotally connected to said first member at a second location along said first member, a link being pivotally secured to the first member proximate said first end of said first member, a first end of said link configured for attachment to the hinged member, a second end of said link having an actuating surface thereon, said first and said second locations being spaced apart along said length of said first member, the second member having a rotating member proximate a second end thereof, wherein when said second end of said first member is pivoted towards the base member the hinged member is moved from the first position to the second position, and wherein when a first end of said second member is pivoted towards the base member the rotating member moves along the actuating surface causing the link to return the hinged member to the first position.

20. The apparatus of claim 19, wherein the hinged member is a toilet seat.

21. An apparatus for moving a hinged member selectively between first and second positions, the apparatus comprising:

a first pedal having first and second ends, said first pedal being pivotally connected to a base member at a first point along said first pedal, said first point being closer to the second end of the first pedal, a second pedal having first and second ends, said second pedal being pivotally connected to said first pedal at a second point along said first pedal, said second point being intermediate said first point and the first end of the first pedal, a link pivotally connected to the first pedal proximate said first end, the first end of said link configured for attachment to the hinged member, the second end of said link having an actuating surface thereon, the second pedal having a pivoting member proximate a second end thereof, wherein when said second end of said first pedal is pivoted towards the base member the hinged member is moved from the first position to the second position, and wherein when a first end of the second member is pivoted towards the base member the pivoting member member moves along the actuating surface causing the link to return the hinged member to the first position.

* * * * *